United States Patent [19]

Sheffer

[11] 4,190,618

[45] Feb. 26, 1980

[54] CARBURETOR

[75] Inventor: Timothy K. Sheffer, Churchville, N.Y.

[73] Assignee: General Motors Corporation, Detroit, Mich.

[21] Appl. No.: 17,080

[22] Filed: Mar. 2, 1979

[51] Int. Cl.[2] ..... F02M 7/16

[52] U.S. Cl. ..... 261/50 R; 123/119 EC; 137/595; 251/65; 261/DIG. 74; 261/121 B

[58] Field of Search ..... 123/119 EC; 261/DIG. 74, 50 R, 121 B; 137/595, 625.65; 251/65

[56] References Cited

U.S. PATENT DOCUMENTS

| | | | |
|---|---|---|---|
| 2,891,577 | 6/1959 | Stewart, Jr. | 137/595 |
| 3,368,788 | 2/1968 | Padula | 251/65 |
| 3,379,214 | 4/1968 | Weinberg | 251/65 |
| 3,460,573 | 8/1969 | Beveridge et al. | 137/625.65 |
| 3,498,330 | 3/1970 | Paige | 137/625.65 |
| 3,608,585 | 9/1971 | Huntington | 137/625.65 |
| 3,827,672 | 8/1974 | Stampfli | 137/625.65 |
| 3,936,516 | 2/1976 | Nakagawa et al. | 261/39 A |
| 4,102,526 | 7/1978 | Hargraves | 137/625.65 |
| 4,128,088 | 12/1978 | Herman | 261/DIG. 74 |

FOREIGN PATENT DOCUMENTS 7700970 11/1978 France .

OTHER PUBLICATIONS

Society of Automotive Engrs., Technical Paper Series 780,204, Feb. 27, 1978.

*Primary Examiner*—Tim R. Miles

*Attorney, Agent, or Firm*—C. K. Veenstra

[57] ABSTRACT

In a carburetor, an electromagnet energized according to a pulse width modulated duty cycle has a stationary pole member which drives a pair of permanently magnetic valves against the bias of a pair of permanently magnetic discs to control fuel flow through a main metering orifice and air flow through an idle air bleed.

6 Claims, 1 Drawing Figure

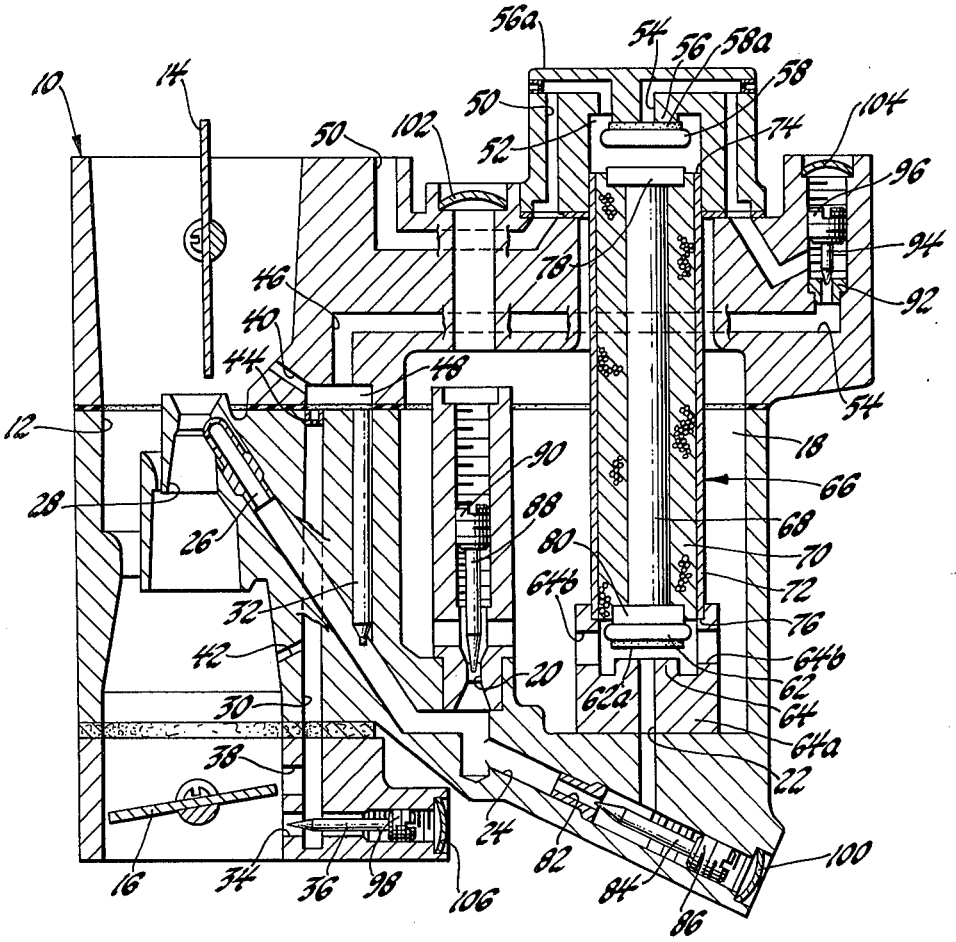
10
14
56a
54
56
58a
58
50
102
104
52
74
96
94
92
46
78
40
44
48
54
12
18
66
28
26
90
88
68
80
70
64b
72
32
76
42
64b
20
62
62a
64
30
64a
38
22
24
82
100
16
34
36
98
106
84
86

CARBURETOR

TECHNICAL FIELD

This invention relates to a carburetor particularly suitable for operation in a closed loop fuel system.

BACKGROUND

Several carburetors have been proposed for the purpose of creating an air-fuel mixture of substantially constant (usually stoichiometric) air-fuel ratio for an internal combustion engine. In general, it has been contemplated that such a carburetor would be used in a closed loop system having a sensor—such as a sensor that measures the oxygen content of the engine exhaust gases as an indication of the air-fuel ratio of the mixture created by the carburetor—which would initiate a feedback signal causing the carburetor to create a mixture of the desired air-fuel ratio.

Certain carburetors proposed for that application have metering apparatus which includes a solenoid armature driven between rich and lean positions according to a pulse width modulated duty cycle. The duty cycle operated solenoid thus maintains the metering apparatus in the lean position for a selected portion of the duty cycle and n the rich position for the remainder of the duty cycle, and the carburetor thus pulse width modulates the fuel flow and then averages high and low fuel flows to create a mixture of the desired air-fuel ratio.

It will be appreciated that, with such a carburetor, the solenoid must operate at a frequency sufficiently high to avoid inducing objectionable engine surge which could result from the alternate high and low fuel flows. The metering apparatus accordingly is subject to a minimum frequency limitation, and its mass and frictional characteristics must be low enough to permit its movement between the rich and lean positions at the minimum frequency over the desired range of duty cycle pulse widths.

U.S. patent application Ser. No. 959,104 Nov. 9, 1978 in the name of D. D. Stoltman depicts another carburetor having structure particularly suited for direct pulse width modulation of the fuel flow. In that carburetor the metering apparatus comprises magnetically responsive valves driven by a stationary electromagnet pole member to control a main metering orifice and an idle air bleed; in one position the metering valve restricts fuel flow through the main metering orifice while the bleed valve permits increased air flow through the idle air bleed to restrict idle fuel flow, and in the opposite position the mtering valve permits increased fuel flow through the main metering orifice while the bleed valve restricts air flow through the idle air bleed to permit increased idle fuel flow. The mass and frictional characteristics of the metering apparatus in that carburetor could be substantially lower than that of the metering apparatus in the carburetor which have a moving solenoid armature that mechanically drives metering and bleed valves.

SUMMARY OF THE INVENTION

This invention provides an improved carburetor in which both the main metering valve and the idle air bleed valve are permanently magnetic and are biased to one position by stationary permanent magnets and driven to the other position by a stationary electromagnet pole member. This construction assures that the two valves move simultaneously.

The details as well as other features and advantages of this invention are set forth in the remainder of the specification and are shown in the accompanying drawing.

SUMMARY OF THE DRAWING

In the drawing, the sole FIGURE is a schematic view of the main and idle metering systems of a carburetor employing this invention and in which the metering apparatus is biased to the rich position when the electromagnet coil is not energized.

BEST MODE FOR CARRYING OUT THE INVENTION

Referring to the drawing, an internal combustion engine carburetor 10 has an air induction passage 12 controlled by a choke 14 and a throttle 16. A fuel bowl 18 delivers fuel through a primary main metering orifice 20 and a supplementary main metering orifice 22 into a main fuel passage 24 which discharges through a nozzle 26 into a venturi cluster 28 disposed in induction passage 12.

An idle fuel passage 30 has a pick-up tube 32 extending into main fuel passage 24, an idle discharge port 34 opening into induction passage 12 past a mixture adjusting needle 36, and an off-idle port 38 opening into induction passage 12 adjacent throttle 16.

The usual side idle air bleed 40 and lower idle air bleed 42 open into idle fuel passage 30 on opposite sides of an idle channel restriction 44, and an air bleed passage 46 extends to the upper portion 48 of idle fuel passage 30. Air bleed passage 46 includes an inlet portion 50 extending to an annular region 52 and a discharge portion 4 which opens through a boss 56 surrounded by annular region 52 and leads to idle fuel passage 30.

An air bleed valve member 58 controls air flow from annular region 52 to discharge portion 54 of air bleed passage 46. When seated across boss 56, bleed valve 58 restricts air flow through bleed passage 46 to permit increased fuel flow through idle fuel passage 30. When bleed valve 58 is displaced from boss 56, the increased air flow permitted through bleed passage 46 restricts fuel flow through idle fuel passage 30.

A metering valve member 62 controls fuel flow from fuel bowl 18 through supplementary metering orifice 22. When metering valve 62 engages a boss 64 surrounding supplementary metering orifice 22, it restricts fuel flow through orifice 22 and passage 24. With metering valve 62 displaced from boss 64 as shown, increased fuel flow is permitted through orifice 22 and main fuel passage 24.

Bleed valve 58 and metering valve 62 comprise metering apparatus which is driven by an electromagnet assembly 66. Electromagnet assembly 66 includes a stationary electromagnet pole member 68 disposed within an electromagnet coil 70. Coil 70 is surrounded by a casing 72 which terminates below bleed valve 58 at its upper end 74 and terminates above metering valve 62 at its lower end 76.

Both bleed valve 58 and metering valve 62 are permanently magnetic, and permanently magnetic discs 78 and 80 are disposed at opposite ends of coil 70 and extend slightly beyond the upper and lower ends 74 and 76 of casing 72. When coil 70 is not energized, permanently magnetic bleed valve 58 is repelled by permanently magnetic disc 78 and thus is biased to a rich position engaging boss 56—thereby restricting air flow through bleed passage 46 to permit increased fuel flow through idle fuel passage 30. In addition when coil 70 is not energized, permanently magnetic metering valve 62 is attracted by permanently magnetic disc 80 and thus is biased to a rich position engaging disc 80—thereby permitting increased fuel flow through metering orifice 22.

When coil 70 is energized, bleed valve 58 is attracted against the bias of disc 78 to a lean position engaging disc 78–thereby permitting increased air flow through bleed passage 46 to restrict fuel flow through idle fuel passage 30. In addition, when coil 70 is energized, metering valve 62 is repelled against the bias of disc 80 to a lean position engaging boss 64—thereby restricting fuel flow through metering orifice 22 and main fuel passage 24.

It is contemplated that coil 70 will be energized according to a duty cycle of about 15 Hz having a pulse width determined by a sensor measuring the air-fuel ratio of the mixture created by carburetor 10—such as a sensor measuring the oxygen content of the engine exhaust gases—and accordingly will repel metering valve 62 against boss 64 and attract bleed valve 58 against disc 78 for a selected portion of the duty cycle while permitting disc 78 to repel bleed valve 58 against boss 56 and disc 80 to attract metering valve 62 for the remainder of the duty cycle; carburetor 10 thus will pulse width modulate the fuel flow and then average high and low fuel flows to create a mixture having a stoichiometric air-fuel ratio or any other desired air-fuel ratio.

Valves 58 and 62 and discs 78 and 80 are formed of a fuel resistant synthetic carrying magnetic particles, such as ferrite filled nylon, and valves 58 and 62 are provided with fuel resistant synthetic gaskets **58*a* and 62*a*, such as epichlorohydrin coated dacron, bonded to the boss-engaging faces thereof. (In this respect, it will be noted that the boss-engaging surfaces of valves 58 and 62 are of the same polarity and valves 58 and 62** thus are interchangeable.)

This structure is particularly advantageous because both the metering valve 62 and the bleed valve 58 are driven both to the rich position and to the lean position by magnetic forces and synchronous operation of the valves is thereby assured.

It also is contemplated that boss 56 will be a portion of an aluminum member **56*a* and that boss 64 will be a portion of a brass member 64*a* having apertures 64*b* to allow fuel flow from fuel bowl 18 to supplementary metering orifice 22**.

A restriction 82 is disposed in main fuel passage 24 between primary metering orifice 20 and supplementary metering orifice 22. A rich adjusting needle 84 has a threaded stem 86 allowing adjustment of needle 84 in restriction 82 to limit fuel flow through supplementary metering orifice 22 and thus establish the maximum fuel flow through main fuel passage 24 to set the rich part throttle authority for carburetor 10. A lean adjusting needle 88 is disposed in primary metering orifice 20 and has a threaded stem 90 allowing adjustment of needle 88 in primary orifice 20 to limit fuel flow through primary metering orifice 20 and thus establish the minimum fuel flow through main fuel passage 24 to set the lean part throttle authority for carburetor 10.

A restriction 92 is disposed in the discharge portion 54 of bleed passage 46. An air bleed adjusting needle 94 is disposed in restriction 92 and has a threaded stem 96 allowing adjustment of needle 94 in restriction 92 to limit air flow through bleed passage 46 and thus control fuel flow through idle fuel passage 30 to set the lean idle authority for carburetor 10. Mixture adjusting needle 36 has a threaded stem 98 allowing adjustment of neelde 36 in port 34 to limit fuel flow through port 34 and thus establish the maximum fuel flow through idle fuel passage 30 to set the rich idle authority for carburetor 10.

Plugs 100, 102, 104 and 106 are installed to seal access to rich and lean adjusting needles 84 and 88, air bleed adjusting needle 94 and mixture needle 36.

With this construction the carburetor metering apparatus will meter fuel flow between the rich authority and the lean authority when coil 70 is operated at any duty cycle pulse width between 0% and 100%.

It will be appreciated that this invention may be embodied in a two-barrel carburetor by addition of another induction passage 12, main fuel passage 24, supplementary metering orifice 22 (with perhaps another primary metering orifice 20), idle fuel passage 30, and a segment of an air bleed passage which branches from discharge portion 54 downstream of air bleed adjusting needle 94 to the second idle fuel passage; duplication of electromagnet assembly 66, bleed valve 58 and metering valve 62 is not required. Moreover, this invention may be embodied in a multiple stage carburetor by addition of one or more secondary stage induction passages and associated systems of conventional construction.

The embodiments of the invention in which an exclusive property or privilege is claimed are defined as follows:

1. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are permanently magnetic, and wherein said carburetor further comprises an electromagnet pole member associated with said valves, an electromagnet coil surrounding said pole member for causing said pole member to drive said valves to one of said rich and lean positions when said coil is energized, and permanent magnet means for biasing said valves to the other of said rich and lean positions when said coil is deenergized.

2. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are permanently magnetic, and wherein said carburetor further comprises an electromagnet pole member associated with said valves, an electromagnet coil surrounding said pole member and energized according to a duty cycle which causes said pole member to drive said valves to one of said rich and lean positions during a portion of the duty cycle, and permanent magnet means for biasing said valves to the other of said rich and lean positions during the remainder of the duty cycle.

3. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are permanently magnetic, and wherein said carburetor further comprises an electromagnet pole member associated with said valves, an electromagnet coil surrounding said pole member for causing said pole member to drive said valves to said lean position when said coil is energized, and permanent magnet means for biasing said valves to said rich position when said coil is deenergized.

4. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are permanently magnetic, and wherein said carburetor further comprises an electromagnet pole member associated with said valves, an electromagnet coil surrounding said pole member for causing said pole member to repel said metering valve and attract said bleed valve to said lean position when said coil is energized, and permanent magnet means for biasing said valves to said rich position when said coil is deenergized.

5. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are permanently magnetic, and wherein said carburetor further comprises an electromagnet pole member associated with said valves, an electromagnet coil surrounding said pole member for causing said pole member to repel said metering valve and attract said bleed valve to said lean position when said coil is energized, and a permanently magnetic member adjacent said metering valve for attracting said metering valve to said rich position when said coil is deenergized, and a permanently magnetic member adjacent said bleed valve for repelling said bleed valve to said rich position when said coil is deenergized.

6. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are permanently magnetic, and wherein said carburetor further comprises an electromagnet pole member disposed between said valves, an electromagnet coil surrounding said pole member and energized according to a duty cycle which causes said pole member to repel said metering valve and attract said bleed valve to said lean position during a portion of the duty cycle, a permanently magnetic member at the end of said pole member adjacent said metering valve for attracting said metering valve to said rich position during the remainder of said duty cycle, and a permanently magnetic member at the end of said pole member adjacent said bleed valve for repelling said bleed valve to said rich position during the remainder of said duty cycle.

* * * * *